United States Patent [19]

Grigar et al.

[11] Patent Number: 4,574,892

[45] Date of Patent: Mar. 11, 1986

[54] TUBING CONVEYED PERFORATING GUN ELECTRICAL DETONATOR

[75] Inventors: Larry L. Grigar, East Bernard; Carl B. Miller, Houston, both of Tex.

[73] Assignee: Halliburton Company, Duncan, Okla.

[21] Appl. No.: 664,126

[22] Filed: Oct. 24, 1984

[51] Int. Cl.[4] ..... E21B 23/00; E21B 43/119

[52] U.S. Cl. ..... 175/4.51; 166/55; 166/297; 166/113; 166/385; 175/4.56

[58] Field of Search ..... 166/55, 55.1, 65, 66, 166/113, 385, 250, 297, 299; 175/4.6, 4.52, 4.54, 4.56, 4.51

[56] References Cited

U.S. PATENT DOCUMENTS

| | | | |
|---|---|---|---|
| 1,641,483 | 9/1927 | Greene | 175/4.56 X |
| 2,705,920 | 4/1955 | Kanady | 175/4.56 X |
| 2,873,675 | 2/1959 | Lebourg | 175/4.6 |
| 2,876,843 | 3/1959 | Huber | 175/4.56 |
| 2,986,214 | 5/1961 | Wiseman, Jr. et al. | 166/297 X |
| 3,180,261 | 4/1965 | Moore | 175/4.56 X |
| 4,512,418 | 4/1985 | Regalbuto et al. | 175/4.56 |

*Primary Examiner*—Stephen J. Novosad
*Attorney, Agent, or Firm*—W. J. Beard

[57] ABSTRACT

For use with a tubing conveyed perforating gun assembly, a wireline manipulated electrically actuated detonator assembly traversing the interior of the tubing is described. In the preferred and illustrated embodiment, a wireline connected with a sinker bar supports the detonator assembly having a sinker bar sub terminating in a taper adjacent to a set of deflectable collet fingers comprising a latch assembly. The collet fingers are deflected outwardly by the tapered surface and are forced into an undercut located above a booster and detonating cord affixed to the tubing conveyed perforating gun assembly for firing the perforating guns.

13 Claims, 2 Drawing Figures

TUBING CONVEYED PERFORATING GUN ELECTRICAL DETONATOR

BACKGROUND OF THE DISCLOSURE

Tubing conveyed perforating guns have found great success in well completion. They are run on a tubing string lowered into a well, typically occurring after casing has been cemented in place. It is possible to adequately perforate a well with just a few shaped charges forming perforations through the casing and external cement thereabout, the perforations extending into the formation to enable fluid flow from the formation into the well. On the other hand, there are occasions where a large number of perforations must be formed and hence, the tubing conveyed perforating gun assembly might be quite long. Moreover, it can be substantially dense with tightly packed perforating guns spaced along the casing. Further, the perforating guns are often arranged to form as many as three perforations at a common elevation with 120° angular orientation between shaped charges forming the perforations.

The perforating gun assembly is typically lowered on a tubing string into a well below an isolation packer to isolate the production zone. Typically, the perforating gun assembly ignites a detonating cord extending to and past all of the shaped charges. The detonating cord is ignited from the top of the perforating gun assembly and the individual shaped charges are thus ignited as the detonating cord detonates past the shaped charges. For safety sake, it is desirable that the detonator mechanism for the perforating gun assembly be separate and isolated from the tubing conveyed perforating gun assembly.

To this end, the present disclosure is directed to a separate firing mechanism, known hereinafter as a detonator, which detonator is not placed in the well until it is established that the shaped charges are properly positioned in the cased well. Usually, the tubing which is fed into the well to locate the perforating gun assembly is measured. Its location in the well can be routinely assured by running an electric log (usually a gamma ray) inside the tubing and then correlating this log to previously run open hole logs.

This apparatus enables the convenience of a wireline delivery system to be used to position the detonator in operative proximity of the tubing conveyed perforating gun assembly. The difficulty with using a wireline is the uncertainty arising from the location of the detonator. That is, when a wireline run device is lowered into a well, it may land at a desired elevation; on the other hand, it may land elsewhere and not be at the desired elevation. Thus, it may be on bottom at the precise required elevation, or it may be snagged thereabove. The lose of weight on the wireline is some indication; it is an indication which may be accurate and which may some times be misleading as slack observed in the wireline creates deception as to the location of the tool supported on the wireline.

There is required spacing between the detonator and the detonating cord. If the detonator lowered on the wireline is too remote, the detonator (when fired) will not in turn ignite the detonating cord. The detonator cannot be markedly increased in size, thereby obtaining a more potent explosive, because it may very well be so large as to destroy the detonator which may make it difficult or impossible to retrieve the detonator. Thus, there is an upper limit in the explosive capacity of the detonator. Accordingly, this apparatus sets forth a wireline detonator which can be run into the tubing which supports the perforating gun assembly. This apparatus sets forth a landing surface in the tubing and an undercut shoulder spaced thereabove. The distance between the two is a fixed measure which is in turn noted in proportioning the detonator assembly whereby locking collet fingers expand to hold against the undercut. At this juncture, the wireline can then be easily manipulated to determine whether or not the tool has been properly seated. If the wire line is first slacked and then a pull is taken to a specified tension, and the detonator assembly does not move, it can then be ascertained that the detonator assembly has been placed in operative proximity of the detonating cord whereby detonation can then be achieved. Thus, a positive locking system is provided so that the detonator is positively brought into operative position relative to the detonating cord. Once the locking sequence has been accomplished and firing of the guns can then be safely assured the wireline is then used to deliver an electrical signal for operation of the detonator. When triggered, the detonator ignites a shaped charge which in turn ignites the detonating cord and fires the perforating guns.

As will be understood, the present apparatus provides optimum safety in that the detonator is not brought into operative position relative to the detonating cord; premature detonation is avoided, and a positive locking system is incorporated whereby safe detonation is assured, thereby igniting the detonating cord and assuring timely and properly located firing of the shaped charges.

While the foregoing speaks in very general fashion of certain features of the present apparatus, the structure is described more readily on reference to the detailed written description found below.

BRIEF DESCRIPTION OF THE DRAWINGS

So that the manner in which the above recited features, advantages and objects of the present invention are attained and can be understood in detail, more particular description of the invention, briefly summarized above may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
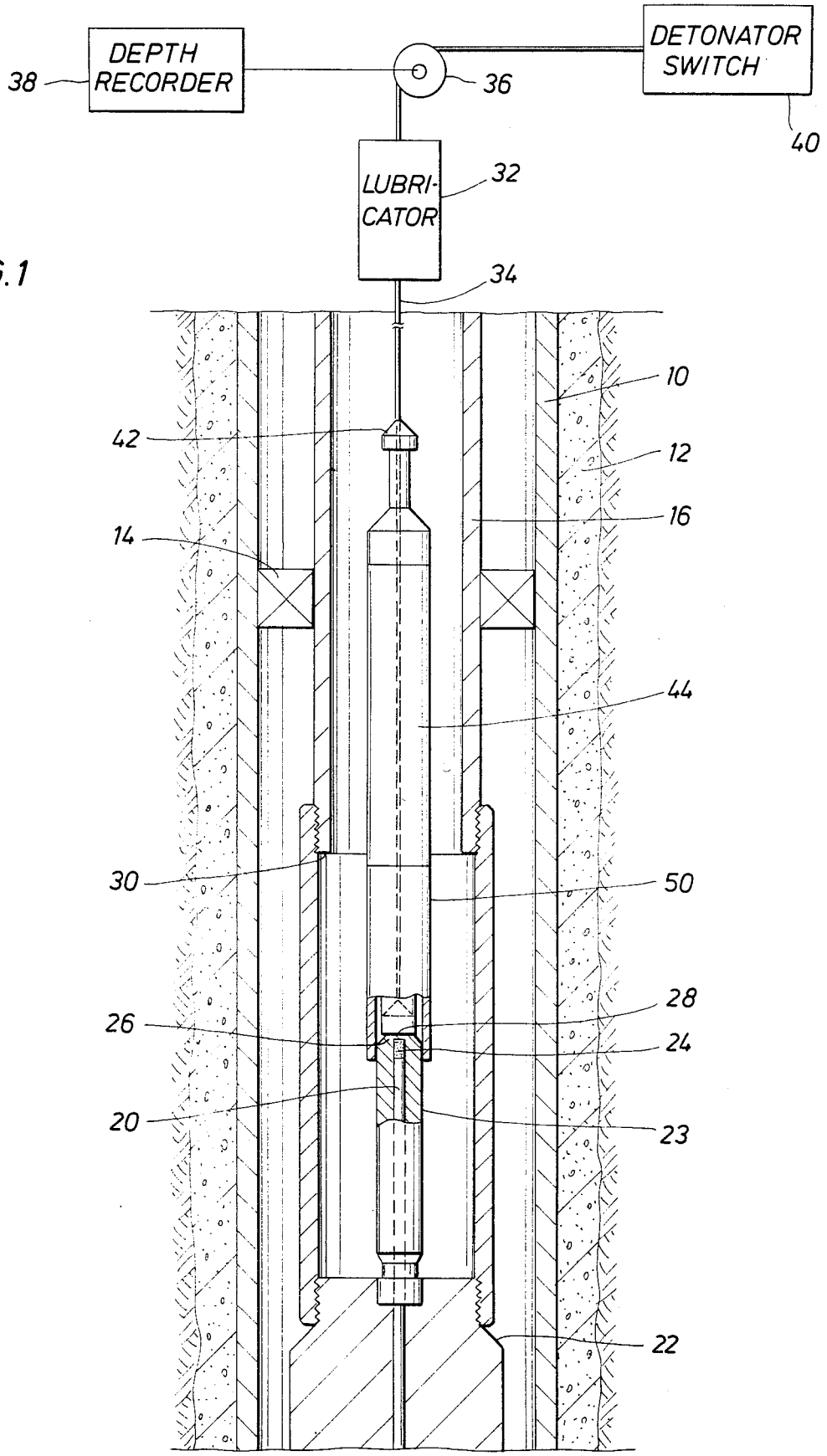
FIG. 1 shows a tubing conveyed perforated gun assembly in a cased well borehole wherein the wireline manipulated detonator is lowered within the tubing, landed, locked in position and subsequently ignited for firing the perforating guns.

Attention is first directed to FIG. 1 of the drawings which shows a cased well borehole preparatory to ignition of a tubing conveyed perforating gun assembly. In FIG. 1 of the drawings, the numeral 10 identifies a casing within a well borehole. It is held in place by cement 12 on the exterior. It is desirable to form one or more perforations through the casing 10, the cement 12 and into the adjacent formations for producing oil from the formations into the well drilled through the formations. A packer 14 is located at some elevation in the well to isolate a zone where perforations are required. Typically, the perforations are formed below the packer. A tubing string 16 is lowered into the well to support a perforating gun assembly which includes a plurality of shape charges. Typically, between one and three shaped charges are located at a common elevation; they are pointed outwardly at selected directions and can be as close as 120° in angular orientation. They can be tightly packed vertically, even as many as 12 per foot, or they can be more loosely distributed. The shaped charges which make up the perforating guns are thus supported below the tubing string 16. The shaped charges are thus positioned in the well below the packer 14. The packer 14 typically isolates the zone or strata which is to be perforated. Moreover, the tubing string 16 is anchored to assure that the shape charges (not shown) are properly positioned and supported beneath the packer 14.

A portion of the perforating gun assembly has been illustrated sufficient to show a detonating cord 20 located below the packer 14. It extends past all the shaped charges to detonate them. It passes through a connective sub 22 which supports the shaped charges therebelow and which also positions the detonating cord 20 centrally. The detonating cord extends up through a supportive stinger 23, the detonating cord 20 being connected with an explosive booster 24. The booster 24 is located in a housing 26 which faces upwardly. The top face of the housing is a registration surface 28. The surface 28 is located so that the wireline lowered tool (to be described) is registered on the surface 28, and is positioned to assure that the booster 24 is properly ignited, thereby igniting the detonating cord 20 to assure proper detonation of the shaped charges. Further, the registration surface 28 is a positive stop, thereby preventing overrunning. The registration surface 28 is spaced a particular distance below an undercut shoulder 30. This serves as a latching shoulder. The shoulder 30 is a part of the tubing 16 which is run into the well to position the perforating gun assembly.

At the wellhead, a lubricator 32 enables a wireline 34 to be fed into the well over a sheave 36. The sheave is connected by suitable mechanical or electronic means to a depth recorder 38. It will be understood that the wireline can be measured as it is fed into the well. There is a risk of hanging which risk is eliminated by the apparatus to be described and therefore, the depth recorder 38 is fairly well able to ascertain that the wireline supported tool (to be described) is at the requisite depth in the well. Moreover, the lubricator 32 enables the wireline 34 to be forced into the well against pressure, all dependent on operating conditions, whereby the tubing 16 guides the wireline supported tool to the desired elevation. The wireline is used to lower the tool, and it also is used to provide an electrical signal from a detonator switch 40 for timed detonation of the detonator to trigger firing of the perforated gun assembly.

The wireline 34 is thus connected at the lower end to a fishing neck 42 which is in turn connected with a sinker bar 44. The sinker bar 44 has a specified length and weight. In turn, it is connected to the detonator assembly 50 of this disclosure. The detonator assembly 50 has been represented in schematic form in FIG. 1 and is cooperative with the registration surface 28 and the locking (undercut) shoulder 30. More will be noted regarding the detonator assembly 50 on reference to FIG. 2 of the drawings.

Figure 2:
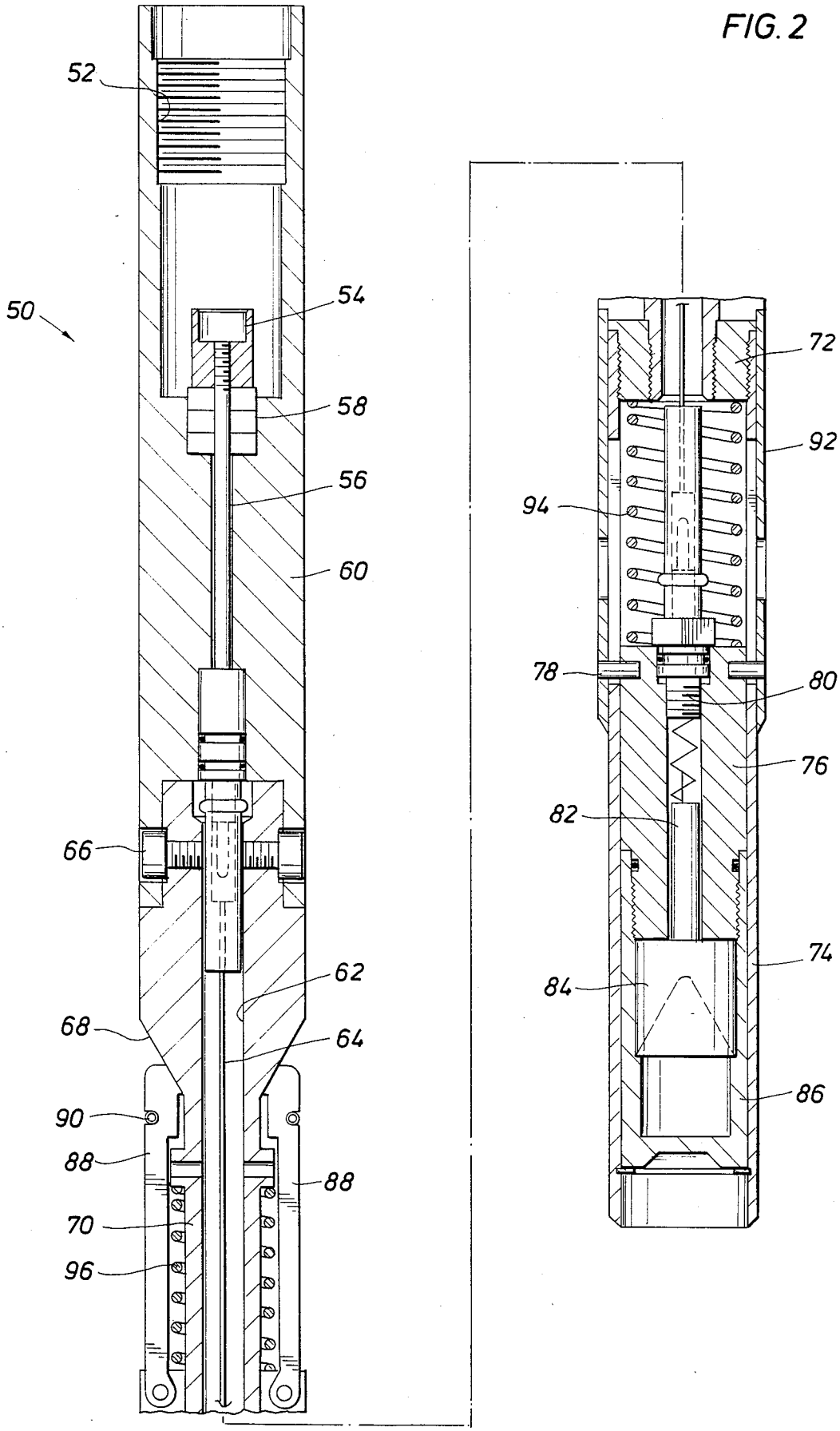
FIG. 2 is a sectional view taken through the wireline supported detonator assembly.

Proceeding from the top of FIG. 2, the apparatus includes an upstanding internally threaded skirt 52 enabling threaded assembly with the sinker bar 44. The sinker bar is provided with an electrical connection therethrough, this being partly indicated in dotted line in FIG. 1. The electrical conductor path connects with an electrical contact assembly 54 to assure electrical connection through the sinker bar. In other words, the detonator switch 40 connects serially to the wireline 34 which in turn is connected through the sinker bar 44 to the contacts 54. This delivers the electrical signal to obtain firing. The electrical contact 54 electrically connects the sinker bar to the detonator 50. Suitable insulators 58 prevent electrical shorting. The threaded skirt 52 on the sinker bar sub 60 connects with the sinker bar. It is axially drilled to receive the connector 56. The connector 56 extends through the equipment into a larger drilled hole at 62 whereupon the connector 56 enables electrical continuity to be achieved by means of a downwardly coiled electrical conductor 64. It is coiled to enable telescoping movement of the components without pinching or stretching.

The sub 60 at the upper end of the tool joins to the next portion which continues the same external diameter. This portion is tapered so as to present a wedge shaped circumferential face. To this end it will be identified as the slip assembly 68. This particularly includes the exposed inwardly tapered conic surface. That surface is used to deflect a latch mechanism radially outwardly as will be described. The two cylindrical components are joined together by means of cap screws 66. They are thus telescoped together and the screws additionally fasten or secure the two components to assure ease of assembly. The cap screws 66 can be removed to enable access to the electrical connector 56 so that it can be disconnected from the conductor 64.

The structure is thinner below the tapered surface and has the form of a downwardly dependent centrally located hollow tubular extension 70. The tubular extension 70 is relatively long, and threads to a threaded latch nut 72 at its lower extremity. It is hollow to receive the coil electrical conductor 64. The latch nut 72 threads on the exterior and connects with an outer housing 74 which extends to the bottom of the tool. The outer housing 74 is hollow. One of the components placed on the interior of the housing 74 is the detonator housing 76. It is moved in the outer housing by sliding axially, and it is pinned by suitable drive pins 78. The detonator housing is a solid member which is axially drilled. At the upper end, it receives and supports a connector 80. The connector 80 is connected to the lower end of the coiled electrical conductor 64.

Observe that the connectors 56 and 80 are spaced apart by a distance which is subject to variation as will be described and hence, the conductor 64 is coiled to permit elongation. The detonator housing 76 is hollow. At the upper end the connector 80 is shown; at the lower end, an electric blasting cap 82 is positioned on the interior of the drilled passage. The blasting cap 82 is immediately adjacent to a shaped charge 84. The shaped charge is constructed to direct a downwardly focused jet for ignition of the booster 24 shown in FIG. 1. More will be noted regarding this hereinafter. The shaped charge 84 is held in position by a charge housing 86 which is telescoped into the outer housing 74 and which is held in position by a snap ring to assemble the shaped charge 84 adjacent to the blasting cap 82.

Returning back up the body of the tool, there are several pivoted collet fingers 88 which deflect radially outwardly. They are pulled inwardly by a surrounding garter spring 90. The collet fingers have a conforming face which rides on the tapered surface at 68. They are shown in the retracted position at the urging of the garter spring 90. As will be understood, when they deflect outwardly, this movement enables the collet fingers 90 to catch below the shoulder 30 shown in FIG. 1. That is, when the detonator assembly 50 is run into the tubing string, the collet fingers 90 are recessed. The tool is streamlined and will not snag or catch on any surface. Eventually, it is received on the registration surface 28 at the bottom of the tubing string. As will be described, the collet fingers are forced radially outwardly and become larger, sufficiently so that they snag or abut against the shoulder 30. This assures that the tool has been properly located.

As will be observed, the collet fingers 88 are relatively long, having a pivotal connection with a drive sleeve 92. The drive sleeve 92 is affixed to the drive pins 78. The drive pins 78 assure that the bottommost components shown in FIG. 2 move together as a unit and that movement is coupled upwardly through the drive sleeve 92 and imparted to the collet fingers 88. Thus, those portions of the equipment located below the detonator housing 76 move as a unit upwardly. When they move, they compress a spring 94. Such movement (compression of the spring 94) is conveyed through the drive sleeve 92 on the exterior of the spring 94. The movement forces the collet fingers 88 upwardly along with compression of the spring 94. In addition, such movement also compresses a second spring 96. This spring will be described as the latch spring. In light of the relative weight bearing on the tool (recall the sinker bar 44), the springs are relatively light, and sufficient compression occurs in the tool shown in FIG. 2 whereby the collet fingers 88 are forced outwardly.

The operation of this device can be more readily understood by description of a sequence of events which occur. Assume for instance that the tubing string 16 is in place, operatively passing through the packer 14, and that the shaped charges therebelow are properly positioned. Assume further that the wireline 34 has been fed through the lubricator 32 and the assembly including the detonator assembly 50 is lowered into the well through the tubing 16. Assume further that the detonator cap 82 is properly in place adjacent to the shaped charge 84. In this event, the wireline tool is lowered by feeding the wireline into the tubing string through the lubricator until the weight on the wireline markedly drops. At this juncture, the depth recorder 38 can be consulted to see whether or not the approximate necessary length of wireline has been fed into the well to determine whether or not the detonator assembly 50 is at the requisite depth in the well. There is ambiguity in this data; that is, the wireline may compress easily and thereby create misleading data. If the packer is 10,000 feet deep, there is some degree of ambiguity even when 10,000 feet of wireline has been fed into the tubing 16 and this depth is indicated at the recorder 38. Whatever the case, this apparatus overcomes such ambiguity. If the tool is not "on bottom" and has not latched, the wireline can be retrieved. If retrieval can occur, then it was not properly registered at the bottom.

If it is on bottom, the detonator assembly 50 will hold, thus assuring that the detonator assembly is in operative proximity of the booster 24 for triggering the detonating cord 20 and properly operating the shaped charges.

The latter is accomplished wherein the detonator assembly 50 is lowered until it rests on the registration surface 28. Assume for purposes of illustration that the sinker bars therabove weighs 75 pounds. As that weight is released by placing slack in the wireline, the weight compresses the detonator assembly 50 shown in FIG. 2 of the drawings. When this occurs, the collet fingers 88 are expanded. They are forced radially outwardly. In typical scale, the I.D. of the tubing string is typically only about two inches. The collet fingers need only deflect outwardly by a fraction of an inch. If such deflection does occur as a result of resting the sinker bar weight on the detonator assembly 50 which in turn rest on the registration surface 28, then the collet fingers are deflected outwardly into a jamming or locking position. When this occurs, the collet fingers jam against the latch shoulder 30. If tension is then taken on the wireline and with an adequate pull, nothing moves, then it is a positive or failsafe indication that the detonator assembly 50 has been received at the proper elevation, has registered, and is now in position to be triggered. At the proper moment, the detonator switch 40 can be actuated to provide the electrical signal down the wireline which is ultimately transferred to the blasting cap which ignites the shaped charge 84, in turn igniting the booster 24, and firing the shaped charges which are connected to the detonating cord 20. This properly operates the shaped charges.

When firing does occur, there is a reaction occurring at the detonator assembly 50. It is thrust violently upwardly. It is held in position by the collet fingers 88 which lodge against the latching shoulder 30. The upward jar causes the drive pins 78 to shear. When they shear, this then enables the drive sleeve 92 to slide downwardly. It will slide downwardly by some short distance. When it does, it pulls the collet fingers downwardly. They are pulled inwardly, that is, restored to the original small diameter by the garter spring 90. This then frees the device for easy retrieval because it is no longer expanded. That is, the collet fingers 88 release the shoulder 30, and enables the tool to be retrieved to the surface. This can be done by pulling the tool out of the tubing string on the wireline in the customary fashion.

As will be understood, the firing equipment necessary to obtain operation of the shaped charges in the perforating gun assembly is not brought into near proximity until the desired moment. This enhances the safety of the operation of the device. Moreover, it prevents the device from being located at the wrong elevation. This is particularly important to prevent accidental discharge at an elevation wherein the perforating guns are not fired. Because such operations occur blind to surface personnel, the risk or danger from not firing the perforating gun assembly is quite severe. That is, the situation absent firing of the perforating gun assembly is dangerous. The live explosives might be retrieved at the surface unexpectedly, and significant risk and danger might well occur.

The foregoing is directed to the preferred embodiment, the scope is determined by the claims which follow.

What is claimed is:

1. For use with a tubing conveyed perforating gun assembly which is positioned in a well at a specified depth and which includes shaped charges to be detonated, a detonator assembly run on a wireline in the tubing which comprises:

(a) an elongated body adapted to be passed into the tubing string supporting the tubing conveyed perforating gun assembly;

(b) positive lock means on said elongated body, said lock means being;

(1) inoperative during lowering in the tubing string;

(2) operative to a latching position relative to the tubing string on landing at a requisite depth in the tubing string;

(3) said positive lock means being operated by relative weight exceeding a specified level acting thereon;

(4) wherein said lock means holds said elongated body at a specified elevation indefinitely until released;

(c) a detonator carried on said body for selective detonation to provide an operative detonation delivered to the perforated gun assembly on the tubing string; and (d) detonation signal transfer means for delivery of a detonation signal under control of the operator at the surface of the well.

2. The apparatus of claim 1 wherein said body is axially constructed to define a passage therethrough, there being electrical conductors and cooperative connectors extending an electrical signal path therethrough to said detonator and comprising said detonation signal transfer means.

3. The apparatus of claim 1 wherein said tubing string includes a registration surface at the bottom thereof and a spaced latching shoulder, and wherein said detonator assembly includes a mating and cooperative surface landing on said registration surface to space said positive lock means to expand and thereby engage said latching shoulder to prevent movement.

4. The apparatus of claim 1 wherein said tubing supports an upstanding stinger centrally therein having a detonating cord therein, and said detonator assembly positions said detonator sufficiently close to said stinger to detonate said detonating cord.

5. The apparatus of claim 4 wherein said detonator assembly includes a bottom located receptacle engaging an end of said stinger and wherein said detonator carried thereby is located to detonate said detonating cord.

6. The apparatus of claim 1 including cooperative collet fingers arranged to deflect outwardly by an adjacent deflective conic surface into an expanded position.

7. The apparatus of claim 6 including spring means pulling said collet fingers to a retracted position.

8. The apparatus of claim 7 including means on said body moving said conic surface into engagement with said collet fingers on placing a weight on said body.

9. The apparatus of claim 1 including, on said body, telescoping means setting to force said lock means into a latching position, and shear means shearing to release said telescoping means after the latching position has been achieved to enable release.

10. A method of detonating shaped charges in a well comprising the steps of:

(a) suspending a tubing conveyed perforating gun assembly in a well at a depth for perforation;

(b) lowering a wireline into the tubing to position a detonator in a wireline supported detonator assembly;

(c) landing the detonator on a registration surface in the tubing;

(d) pulling up on the wireline to temporarily lock said detonator above the registration surface and below tubing supported cooperative shoulder means wherein said detonator holds against the upward pull to assure proper positioning relative to said registration surface;

(e) transmitting a firing signal along the wireline to said detonator to initiate detonation at a location assured by registration on said registration surface; and (f) firing the shaped charges by detonation of said detonator.

11. The method of claim 10 including the steps of placing the wireline through a lubricator to isolate the well.

12. The method of claim 10 including the step of expanding radially outwardly lock means of said detonator by placing weight on said detonator for said expansion.

13. The method of claim 12 including the step of placing a sinker bar above said detonator of sufficient weight to actuate said lock means.

* * * * *